US006803492B2

(12) United States Patent
Feustel et al.

(10) Patent No.: US 6,803,492 B2
(45) Date of Patent: Oct. 12, 2004

(54) ADDITIVES BASED ON COMPONENTS PRESENT IN PETROLEUM FOR IMPROVING THE COLD FLOW PROPERTIES OF CRUDE AND DISTILLATE OILS

(75) Inventors: Michael Feustel, Köngernheim (DE); Hans-Jörg Oschmann, Scotland (GB); Utha Kentschke, Clausthal-Zellerfeld (DE)

(73) Assignee: Clariant International Ltd., Muttenz (CH)

( * ) Notice: Subject to any disclaimer, the term of this patent is extended or adjusted under 35 U.S.C. 154(b) by 266 days.

(21) Appl. No.: 10/102,373

(22) Filed: Mar. 20, 2002

(65) Prior Publication Data

US 2002/0193644 A1 Dec. 19, 2002

(30) Foreign Application Priority Data

Mar. 31, 2001 (DE) ..... 101 16 267

(51) Int. Cl.[7] ..... C10M 159/00; C10M 159/04; C10M 159/12; C10M 163/00

(52) U.S. Cl. ..... 585/1; 585/2; 585/3; 585/13; 585/14; 208/14; 208/15; 208/18

(58) Field of Search ..... 585/1, 2, 3, 13, 585/14; 208/14, 15, 18

(56) References Cited

U.S. PATENT DOCUMENTS

| | | | |
|---|---|---|---|
| 3,523,071 | A | 8/1970 | Knapp et al. |
| 3,532,618 | A | 10/1970 | Wunderlich et al. |
| 4,074,978 | A | 2/1978 | Panzer |
| 4,201,658 | A | 5/1980 | Jensen |
| 4,522,707 | A | 6/1985 | Kriegel et al. |
| 4,728,412 | A | 3/1988 | Soderberg |

FOREIGN PATENT DOCUMENTS

| | | |
|---|---|---|
| DE | 28 50 540 | 5/1980 |
| WO | 00/52118 | 9/2003 |

OTHER PUBLICATIONS

Oshmann, H.J., O. Prahl, and D. Saverin, "Separation of Paraffin from Crude Oil by Supercritical Fluid Extraction," Petroleum Science and Technology, 16. 1998, pp. 133–143. English abstract for WO 00/52118, Sep. 8, 2000.

K. Zosel, "Praktische Anwendungen der Stofftrennung mit uberkritschen Gasen", Angew. Chem., 90, (1978), pp. 748–755.

*Primary Examiner*—Elizabeth D. Wood
(74) *Attorney, Agent, or Firm*—Richard P. Silverman

(57) ABSTRACT

The invention relates to an additive for improving the cold-flow properties of crude and distillate oils, where the additive is obtainable by extraction of crude oil with supercritical gas.

11 Claims, No Drawings

ADDITIVES BASED ON COMPONENTS PRESENT IN PETROLEUM FOR IMPROVING THE COLD FLOW PROPERTIES OF CRUDE AND DISTILLATE OILS

BACKGROUND OF THE INVENTION

The present invention relates to a flow improver for crude and distillate oils which is recovered from crude oil by extraction by means of supercritical gases.

Crude oils, residue oils, oil distillates, such as, for example, diesel fuel, mineral oils, lubricating oils, hydraulic oils, etc., contain, depending on their origin or the nature of their processing, varying proportions of n-paraffins and asphaltenes, which represent particular problems since they crystallize out or agglomerate on a reduction in the temperature and can thus result in impairment of the flow properties of these oils. This impairment of the flow properties of the oils is known as "solidification" of the oil. The pour point is the standardized term for the temperature at which an oil, for example mineral oil, diesel fuel or hydraulic oil, just stops flowing on cooling. However, the pour point is not identical with the so-called flow point. The flow point is a non-specific term, not covered by standards, for the temperature at which a solid starts to flow under given measurement conditions. Due to the impairment in the flow properties, tanks, pipelines, valves or pumps may block, for example during transport, during storage and/or during processing of these oils, in particular in the case of paraffin-containing oils, which are difficult to inhibit. In addition, paraffin precipitations require increased pressures during re-start of pipelines (yield point).

Particular difficulties occur in practice if the wax appearance temperature (WAT) and in particular the inherent pour point of these oils is above the ambient temperature, in particular at 20° C. or above. In view of decreasing world oil reserves and increasing exploitation of deposits that yield crude oils with high inherent pour points, the recovery and transport of problem oils of this type is achieving ever-greater importance.

Flowability can be restored or maintained using a number of measures of a thermal or mechanical nature, for example scraping the crystallized paraffin off the inside wall of pipes by regular pigging, heating of entire pipelines, or flushing processes with solvents. It is undoubtedly more elegant to combat the causes of the phenomenon by addition of flow improvers, which are also known as pour point depressants or paraffin inhibitors. A lowering of the pour point to values below the respective ambient temperature, in particular to values of about 10° C. or below, is generally advantageous here.

The way in which these flow improvers work is generally explained as being that they inhibit crystallization of paraffins and asphaltenes or co-crystallize with the paraffins or paraffin/asphaltene adducts and thereby result in the formation of smaller paraffin crystals, which are no longer able to aggregate and form a network which impairs flowability. The consequence is a lowering of the pour point and maintenance of the flowability of the oil at low temperature. The effectiveness of the flow improvers is dependent both on their chemical structure (composition) and on their concentration.

The flow improvers disclosed in the prior art are generally synthetic polymers, which usually contain structural units of ethylene and structural units of unsaturated carboxylic acid esters.

The disadvantage of these flow improvers from the prior art consists in their expensive preparation and their lack of general applicability. Thus, it is generally necessary to re-formulate flow improvers for particular uses.

Besides the said synthetic polymers, the prior art also discloses attempts to prepare cold-flow improvers for oils directly from crude oil or oil products.

U.S. Pat. No. 3,523,071 discloses that the heavy products of a shale oil which has already been subjected to visbreaking are effective pour point depressants for hydrodenitrated shale oil. On the other hand, however, these products have no effect on crude shale oil.

U.S. Pat. No. 3,532,618 discloses the preparation of asphaltenes which act as pour point depressants in shale oil by hydrovisbreaking of shale oil followed by deasphalting of the hydrovisbreaker product stream.

U.S. Pat. No. 4,201,658 likewise discloses a process for lowering the pour point of shale oils. Here, the asphaltenes of a thermally treated shale oil were employed as pour point depressants in relatively high concentrations of up to 12% by weight.

U.S. Pat. No. 4,728,412 discloses the flow-improving action of tar sand bitumen which has been subjected to various treatments in crude oils having a high pour point. Here too, relatively high amounts of up to 60% by weight are used as pour point depressants.

It is evident from all these documents that high concentrations were necessary hitherto for paraffin inhibition using pour point depressants based on components present in petroleum. In addition, all pour point depressants disclosed in these processes first have to be produced by treatment of the crude oils (which are shale oils) at high temperatures.

K. Zosel, Angew. Chem. 90 (1978), pp. 748–755, discloses a process for the deasphalting of top oils. This process uses extraction with supercritical gases. However, the effectiveness of products obtained therefrom is not disclosed.

WO-00/52118 discloses a process for the refining of oils, including petroleum, which is characterized by supercritical extraction of the oils. A flow-improving action of extraction residues is not disclosed.

The object of the present invention is to provide a flow improver which represents an alternative to the synthetic polymers of the prior art. This flow improver should be inexpensive to produce with no additional use of resources compared with the prior art. It should also be effective in smaller amounts than the prior-art pour point depressants based on components present in petroleum and should be producible without heat treatment, including from crude oils.

SUMMARY OF THE INVENTION

Surprisingly, it has now been found that flow improvers based on components present in petroleum can be obtained by extraction of crude oils by means of supercritical gases.

The invention thus relates to an additive for improving the cold-flow properties of crude and distillate oils, where the additive is obtainable by extraction of crude oil with supercritical gas.

The invention furthermore relates to fuel oils which comprise the additives described above.

The invention furthermore relates to the use of an extraction residue obtainable by extraction of crude oil by means of supercritical gases as cold-flow improvers for crude and distillate oils.

The invention furthermore relates to a process for the preparation of an additive which improves the cold-flow properties of crude and distillate oils by subjecting crude oil to extraction by means of supercritical gases, and isolating the resultant extraction residue.

DETAILED DESCRIPTION OF THE INVENTION

Separation of substances by means of supercritical gases (supercritical fluid extraction, SFE) is a well known method in the prior art and its principles will not be discussed here. It is disclosed by way of example in "Angewandte Chemie, Volume 90 (1978), Issue 10, pages 747-761", which is expressly incorporated herein by way of reference.

The additives according to the invention can be obtained from any desired crude oils. The crude oils are preferably conventional crude oils. A preferred embodiment uses resin-rich crude oils which have resin contents of at least 0.5% by weight, in particular at least 5%by weight. The resin contents of the crude oils may be, for example, up to 30% by weight, in particular cases even up to 50% by weight.

The extraction is preferably carried out with nonpolar or slightly polar, low-molecular-weight gases having molecular weights of up to 200, in particular up to 100 units, or mixtures thereof. Examples of suitable gases are carbon dioxide, $C_1$–$C_5$-alkanes, $C_2$–$C_5$-alkenes and $C_1$-$C_3$-fluoroalkanes. Preference is given to $CO_2$, ethylene or propane.

The extraction is generally carried out at pressures of from 50 to 500 bar and at temperatures of from 30 to 150° C., preferably up to 100° C. It should be noted here that the pressure and temperature must be selected so that the extractant is a supercritical gas. In addition to the extractant, an entrainer can be used during the extraction. Entrainers are substances which, when added in small amounts of from 2 to 15 mol %, preferably up to 10 mol %, based on the extractant, improve the yield and selectivity of supercritical extraction. Suitable entrainers are weakly polar or nonpolar organic compounds, such as, for example, isooctane or toluene, or mixtures thereof.

The extraction residue is isolated by removal of the extractant loaded with the extract. It is also possible to effect the isolation by adsorption of the extract onto suitable adsorbents or by changing the temperature, as a result of which the extract is deposited elsewhere from the extractant, and the extractant can be brought into renewed contact with the extraction residue. In a preferred embodiment, the process is carried out in a circulation apparatus with continuous extract deposition.

The direct extraction residue (additive) is suitable for improving the cold-flow properties of crude and distillate oils. In order to increase the effectiveness of the additives according to the invention, the extraction residue can be further processed.

In a preferred embodiment of the invention, the extraction residue obtained from crude oil is extracted with a polar solvent. Suitable polar solvents are $C_3$- to $C_{10}$-alcohols, esters of carboxylic acids having from 2 to 5 carbon atoms with alcohols having from 1 to 5 carbon atoms, in particular esters of acetic acid, such as ethyl acetate. The residue from this extraction is then re-extracted with a nonpolar solvent. Suitable nonpolar solvents are aliphatic solvents, preferably alkanes which are liquid at room temperature, in particular n-pentane. The extract obtained with the nonpolar solvent is the purified flow improver (additive) with increased effectiveness.

The additives according to the invention are suitable for improving the cold-flow properties of crude oils, distillate oils or fuel oils as well as lubricating oils. The oils may be of mineral, animal or vegetable origin.

Besides crude oils and residue oils, particularly suitable fuel oils are middle distillates. The term middle distillates is applied, in particular, to mineral oils which are obtained by distillation of crude oil and boil in the range from 120 to 320° C., such as, for example, kerosene, jet fuel, diesel and heating oil. They may also comprise proportions of alcoholic fuels, such as, for example, ethanol and methanol, or alternatively biofuels, such as, for example, rapeseed oil or rapeseed oil acid methyl ester. In particular, they are effective in oils whose GC-determined content of n-paraffins which have chain lengths of 22 carbon atoms or more is at least 1.0 area-%, in particular greater than 1.5 area-%, especially 2.0 area-% or more. The 90% distillation point of the oils according to the invention is preferably above 345° C., in particular above 350° C., especially above 355° C. These oils preferably have cloud points above −10° C., in particular above −5° C.

The additives can be used alone or alternatively together with other additives, for example with dewaxing aids, conductivity improvers, antifoams, dispersion aids, demulsifiers, asphaltene inhibitors, gas hydrate inhibitors, scale inhibitors, paraffin dispersants, corrosion inhibitors, antioxidants, lubricity additives, dehazers or sludge inhibitors.

The additive components can be added to the oils to be treated with additives together as a concentrate mixture in suitable solvents or also separately.

The additives according to the invention are added to mineral oils or mineral oil distillates in the form of emulsions, solutions or dispersions. The additives according to the invention can also be added to the oils in the form of solid granules or pellets, which is preferably the case in the recovery of crude oil. These solutions or dispersions preferably comprise from 1 to 90% by weight, in particular from 5 to 80% by weight, of the mixtures. Suitable solvents or dispersion media are aliphatic and/or aromatic hydrocarbons or hydrocarbon mixtures, for example gasoline fractions, kerosene, decane, pentadecane, toluene, xylene, ethylbenzene or commercial solvent mixtures, such as solvent naphtha, ®Shellsol AB, ®Solvesso 150, ®Solvesso 200, ®Exxsol, ®ISOPAR and ®Shellsol D grades. The solvent mixtures mentioned comprise various amounts of aliphatic and/or aromatic hydrocarbons. The aliphatics may be straight-chain (n-paraffins) or branched (isoparaffins). Aromatic hydro-carbons may be monocyclic, bicyclic or polycyclic and may optionally carry one or more substituents. Mineral oils or mineral oil distillates whose Theological properties have been improved by the additives according to the invention comprise from 0.001 to 2% by weight, preferably from 0.005 to 0.5% by weight, of the additives, based on the distillate.

For the production of additive packages for specific problem solutions, the additives according to the invention may also be employed together with one or more oil-soluble co-additives, which even on their own improve the cold-flow properties of crude oils, lubricating oils or fuel oils. Examples of co-additives of this type are copolymers of ethylene and ethylenically unsaturated esters, comb polymers, alkylphenol-aldehyde resins and polar compounds which effect paraffin dispersion (paraffin dispersants).

Thus, the additives according to the invention can be employed in the form of a mixture with alkylphenol-formaldehyde resins. In a preferred embodiment of the invention, these alkylphenol-formaldehyde resins are those of the formula

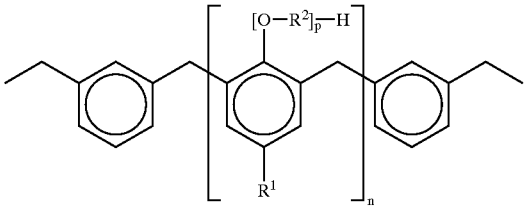

in which $R^1$ is $C_4$–$C_{50}$-alkyl or -alkenyl, [O—$R^2$] is ethoxy and/or propoxy, n is a number from 5 to 100, and p is a number from 0 to 50. Paraffin dispersants reduce the size of the paraffin crystals and have the effect that the paraffin particles do not settle out, but instead remain colloidally dispersed with significantly reduced sedimentation volition. Paraffin dispersants which have proven successful are oil-soluble polar compounds containing ionic or polar groups, for example amine salts and/or amides, which can be obtained by reaction of aliphatic or aromatic amines, preferably long-chain aliphatic amines, with aliphatic or aromatic mono-, di-, tri- or tetracarboxylic acids or anhydrides thereof. Other paraffin dispersants are copolymers of maleic anhydride and α,β-unsaturated compounds, which can, if desired, be reacted with primary monoalkylamines and/or aliphatic alcohols, the products of the reaction of alkenylspirobislactones with amines, and products of the reaction of terpolymers based on α,β-unsaturated dicarboxylic anhydrides, α,β-unsaturated compounds and polyoxyalkylene ethers of lower unsaturated alcohols. Alkylphenol-formaldehyde resins are also suitable as paraffin dispersants.

The mixing ratio (in parts by weight) of the additives with paraffin dispersants is in each case from 1:10 to 20:1, preferably from 1:1 to 10:1.

In a further preferred embodiment of the invention, the additives according to the invention are used in the form of a mixture with ethylene copolymers.

Ethylene copolymers of this type preferably contain from 8 to 20 mol %, in particular from 9 to 13 mol %, of at least one vinyl ester, such as vinyl acetate, vinyl propionate, vinyl butyrate, vinyl hexanoate, vinyl octanoate, vinyl neononanoate and neodecanoate, a $C_1$–$C_{30}$-alkylvinyl ester and/or $C_1$–$C_{30}$-alkyl (meth)acrylate. They furthermore preferably comprise 1–6 mol % of at least one olefin having 3–8 carbon atoms, such as propene, butene, isobutene, diisobutylene, pentene, hexene, 4-methylpentene, norbornene or octene. It is furthermore also possible to employ mixtures of different flow improvers having a different quantitative (for example comonomer content) and/or qualitative composition (type of the copolymers/terpolymers, molecular weight and degree of branching).

According to a preferred embodiment of the invention, the additives according to the invention are employed in the form of a mixture with ethylene-vinyl acetate-vinyl neononanoate terpolymers or ethylene-vinyl acetate-vinyl neodecanoate terpolymers. Besides ethylene, the terpolymers of vinyl neononanoate or vinyl neodecanoate comprise from 10 to 35% by weight of vinyl acetate and from 1 to 25% by weight of the respective neo compound.

In a further preferred embodiment of the invention, the additives according to the invention are employed with terpolymers which, besides ethylene, comprise 10–35% by weight of vinyl esters and from 0.5 to 20% by weight of olefins, such as, for example, diisobutylene, hexene, 4-methylpentene and/or norbornene.

The mixing ratio of the additives according to the invention with the above-described ethylene-vinyl acetate copolymers or the terpolymers of ethylene, vinyl acetate and the vinyl esters of neononanoic or neodecanoic acid or of ethylene, vinyl esters and olefins is (in parts by weight) from 20:1 to 1:20, preferably from 10:1 to 1:10. The mixtures of the additives according to the invention with the said copolymers are particularly suitable for improving the flowability of middle distillates.

EXAMPLES

Example A

Characterization of the Extracted Oils and of the Test Oil

Three German crude oils of different origins (A, B and C) were subjected to extraction with supercritical $CO_2$. These oils are distinguished by the parameters shown in Table 1. The proportions of resins and asphaltenes were determined here by colloid precipitation with ethyl acetate followed by extraction with n-pentane for separation of the resins or extraction with toluene in order to isolate the asphaltenes. All extracted crude oils have a relatively high proportion of resins of greater than 7% by weight.

TABLE 1

Properties of the extracted crude oils

| | Crude oil | | |
|---|---|---|---|
| | A | B | C |
| Density [g/cm³] | 9.1 | 8.9 | 9.1 |
| Asphaltenes [% by wt.] | 4.8 | 0.5 | 0.8 |
| Resins [% by wt.] | 7.9 | 8.4 | 7.8 |
| Dispersion media [% by wt.] | 87.3 | 91.1 | 91.4 |
| Saturated hydrocarbons [% by wt.] | 28.5 | 43.8 | 29.2 |
| Aromatics [% by wt.] | 43.7 | 27.8 | 36.9 |
| Polar compounds [% by wt.] | 27.8 | 28.4 | 33.9 |

Example B

Characterization of the Test Oil to be Treated with Additives

The density of the test oil at 20° C. was 0.8126 kg/l. A wax appearance temperature of 21.1° C. was determined by DSC measurements at a cooling rate of 0.5 K/min. The oil comprised 22.4% by weight of low boilers (compounds which can be distilled off at 80° C. and 60 mbar).

Gas chromatography was used to determine the n-alkane content of the test oil at 62.70 g/l and its paraffin content having a carbon chain length of between $C_{16}$ and $C_{39}$, i.e. paraffins which cause the technical problems outlined above to a particular extent, at 42.75 g/l. The proportion of the individual n-alkanes was distributed as follows:

TABLE 2

Composition of the test oil in the range from $C_{10}$ to $C_{39}$

| n-Alkane | Proportion by wt. [g/l] | n-Alkane | Proportion by wt. [g/l] |
|---|---|---|---|
| $C_{10}H_{22}$ | 1.98 | $C_{25}H_{52}$ | 3.21 |
| $C_{11}H_{24}$ | 2.75 | $C_{26}H_{54}$ | 2.33 |
| $C_{12}H_{26}$ | 3.55 | $C_{27}H_{56}$ | 2.14 |
| $C_{13}H_{28}$ | 3.70 | $C_{28}H_{58}$ | 1.54 |
| $C_{14}H_{30}$ | 4.10 | $C_{29}H_{60}$ | 1.19 |
| $C_{15}H_{32}$ | 3.87 | $C_{30}H_{62}$ | 0.78 |
| $C_{16}H_{34}$ | 3.52 | $C_{31}H_{64}$ | 0.56 |

TABLE 2-continued

Composition of the test oil in the range from $C_{10}$ to $C_{39}$

| n-Alkane | Proportion by wt. [g/l] | n-Alkane | Proportion by wt. [g/l] |
|---|---|---|---|
| $C_{17}H_{36}$ | 3.41 | $C_{32}H_{66}$ | 0.31 |
| $C_{18}H_{38}$ | 3.35 | $C_{33}H_{68}$ | 0.27 |
| $C_{19}H_{40}$ | 3.53 | $C_{34}H_{70}$ | 0.18 |
| $C_{20}H_{42}$ | 3.44 | $C_{33}H_{72}$ | 0.09 |
| $C_{21}H_{44}$ | 3.31 | $C_{36}H_{74}$ | 0.05 |
| $C_{22}H_{46}$ | 3.16 | $C_{37}H_{76}$ | 0.05 |
| $C_{23}H_{48}$ | 3.15 | $C_{38}H_{78}$ | 0.03 |
| $C_{24}H_{50}$ | 3.14 | $C_{39}H_{80}$ | 0.02 |

Example C

Extraction with Supercritical Gas

The extraction of the additives according to the invention from crude oils A, B and C was carried out with a semi-continuous plant using carbon dioxide as extractant. The solvency of the extractant $CO_2$ for saturated hydrocarbons was increased by the additional feed of i-octane as an entrainer. The SFE was carried out under the conditions shown in Table 3.

TABLE 3

Operating conditions set for the SFE

| | | | |
|---|---|---|---|
| Pressure in extractor A1: | 300 bar | Entrainer: | i-octane |
| Pressure in separator A2: | 40 bar | Entrainer flow rate: | 1.8 ml/min |
| Temperature in extractor A1: | 100° C. | | |
| Temperature in separator A2: | 60° C. | Extraction time: | 10 hours |

The extraction residue obtained in this way is referred to as Additive 1. It was then purified further by extraction with ethyl acetate and subsequently with n-pentane. The purified product obtained in this way is referred to as Additive 2.

Example D

Characterization of Additives 1 and 2 According to the Invention

Additives 1 and 2 according to the invention were characterized with respect to the following material properties:

Elemental composition (CHNS analysis): for this purpose, an analytical instrument with thermal conductivity detection was employed (Vario EL from Elementar Analysensysteme GmbH). This instrument enables the determination of the proportions by weight of the elements carbon (C), hydrogen (H), nitrogen (N) and sulfur (S) in the sample. The calibration was carried out using sulfanilic acid as standard.

Mean particle weight: the mean particle weight was determined by vapor pressure osmometry compared with a polystyrene standard.

Structural type distribution: the determination of the structural type distribution was carried out by a combined method of thin-layer chromatography and flame ionization detection (TLC-FID) in accordance with the working procedure of the IP ST-G-2 international inter-laboratory test. This enables the content of saturated hydrocarbon, aromatics and polar compounds in a substance mixture to be determined.

It is evident from the elemental analysis that the proportions of the analyzed elements in Additive 1 and Additive 2 were weighted as follows:

TABLE 4

Elemental composition of Additives 1 and 2

| | Element | | | |
|---|---|---|---|---|
| Inhibitor | Carbon (C) | Hydrogen (H) | Nitrogen (N) | Sulfur |
| Additive 1 | 84–86% by wt. | 12–13% by wt. | 0.2–0.4% by wt. | 1.0–1.4% by wt. |
| Additive 2 | 84–86% by wt. | 11–12% by wt. | 0.4–0.7% by wt. | 1.2–1.6% by wt. |

The remainder is ascribed to the oxygen also present in the Additives. The mean molecular weight of the constituents in Additive 1 was in the range from 1000 to 1300 g/mol, and that of the constituents of Additive 2 was between 3200 and 4300 g/mol. The structural type distribution shown in Table 5 was determined in the Additives:

TABLE 5

Structural type distribution in the Additives

| | Structural type | | |
|---|---|---|---|
| Inhibitor | Saturated hydrocarbons | Aromatics | Polar compounds |
| Additive 1 | 15–25% by wt. | 30–40% by wt. | 40–50% by wt. |
| Additive 2 | 3–8% by wt. | 10–25% by wt. | 70–85% by wt. |

Example E

Action as Cold-flow Improver

The cold-flow improver action of Additives 1 from three crude oils of different origins (crude oils A, B and C) was demonstrated on a test oil with respect to the pour point. In addition, the effectiveness of the corresponding Additives 2 was confirmed by pour point measurements and investigations of the temperature/viscosity behavior of the same test

Example 1

Influence of the Additives on the Pour Point of the Test Oil

The pour point of a mineral oil product is defined in ASTM D 5985-96 as the temperature below which the sample is no longer flowable under the cooling conditions stipulated in the standard. It is thus a crucial quantity for assessment of the flow behavior and also of the storage behavior of substance mixtures of this type. The pour point of the samples investigated here was determined in accordance with the ASTM using a Herzog MC 850 instrument. The pour point of the test oil without Additives was 16.7° C. Table 6 shows how the pour point was lowered by the addition of Additive.

TABLE 6

Effect of the Additives 1 according to the invention as pour point depressant

| Crude oil from which the Additive was obtained | Amount of Additive [ppm] | Pour point [° C.] | Pour point depression [° C.] |
|---|---|---|---|
| A | 500 | 4.8 | 11.9 |
| | 1000 | −2.9 | 19.6 |
| B | 500 | 4.6 | 12.1 |
| | 1000 | −4.7 | 21.4 |
| C | 500 | 4.9 | 11.8 |
| | 1000 | −3.6 | 20.3 |

The addition of 500 ppm of Additive 1 caused a lowering of the pour point, or pour point depresser by about 12° C. to a temperature of about 5° C. An increase in the concentration to 1000 ppm caused the lowering of the pour point by about 20° C. It is notable here that the residues obtained from the three crude oils of different provenance all exhibited virtually the same inhibitor action.

Example 2

Influence of Additives 2 on the Pour Point of the Test Oil

By increasing the concentration of the effective components in the Additives 1, the lowering of the pour point by 20° C. can, as shown in Table 6, be achieved on addition of only 500 ppm of inhibitor.

TABLE 7

Effect of the Additives 2 according to the invention as pour point depressant

| Crude oil from which the Additive was obtained | Amount of Additive [ppm] | Pour point [° C.] | Pour point depression [° C.] |
|---|---|---|---|
| A | 250 | 1.9 | 14.8 |
| | 500 | −3.8 | 20.5 |
| B | 250 | 0 | 16.7 |
| | 500 | −6.2 | 22.9 |
| C | 250 | 3.3 | 13.4 |
| | 500 | −5.1 | 21.8 |

Example 3

Influence of the Additives 2 on the Temperature/Viscosity Behavior of the Test Oil The assessment of the temperature-dependent viscosity behavior of a mineral oil or mineral oil product is important for the design of pump and conveying equipment, which have to be designed at significantly greater cost with increasing viscosity due to the higher performance required. It was therefore also investigated how the temperature/viscosity behavior is affected by the addition of 500 ppm of the Additives obtained from the second step. The measurements were carried out using a Haake Rot 30 rotational viscometer with the NV (low viscosity) measuring system and the M5 measuring head. Starting from an initial temperature of 45° C., the samples were cooled at a cooling rate of 0.5 K/min with a constant shear rate of 100 $s^{-1}$. The measured data for the viscosity were recorded as a function of the temperature via the connected computer system.

TABLE 8

Viscosities of the test oil with and without additive as a function of temperature in [mPas]

| Temperature [° C.] | Sample: Test oil without additive | Test oil with 500 ppm of additive 2A | Test oil with 500 ppm of additive 2B | Test oil with 500 ppm of additive 2C |
|---|---|---|---|---|
| 45 | 4.00 | 2.23 | 1.93 | 3.53 |
| 44 | 4.12 | 2.21 | 1.92 | 3.69 |
| 43 | 4.58 | 2.11 | 1.94 | 3.81 |
| 42 | 4.75 | 2.27 | 1.97 | 3.93 |
| 41 | 5.25 | 2.32 | 1.92 | 4.08 |
| 40 | 5.29 | 2.44 | 1.85 | 4.24 |
| 39 | 5.43 | 2.47 | 1.92 | 4.37 |
| 38 | 5.11 | 2.60 | 2.02 | 4.53 |
| 37 | 5.32 | 2.60 | 1.93 | 4.63 |
| 36 | 5.31 | 2.76 | 2.00 | 4.77 |
| 35 | 5.71 | 2.90 | 2.21 | 4.91 |
| 34 | 6.01 | 2.95 | 2.34 | 5.03 |
| 33 | 6.07 | 3.09 | 2.48 | 5.15 |

TABLE 8-continued

Viscosities of the test oil with and without additive as a function of temperature in [mPas]

| Temperature [° C.] | Sample: Test oil without additive | Test oil with 500 ppm of additive 2A | Test oil with 500 ppm of additive 2B | Test oil with 500 ppm of additive 2C |
|---|---|---|---|---|
| 32 | 6.32 | 3.30 | 2.66 | 5.38 |
| 31 | 6.35 | 3.46 | 2.70 | 5.57 |
| 30 | 6.39 | 3.58 | 2.80 | 5.73 |
| 29 | 6.60 | 3.71 | 2.94 | 5.87 |
| 28 | 6.76 | 3.98 | 3.05 | 6.07 |
| 27 | 6.80 | 4.10 | 3.12 | 6.27 |
| 26 | 7.25 | 4.27 | 3.34 | 6.48 |
| 25 | 7.50 | 4.40 | 3.54 | 6.74 |
| 24 | 7.79 | 4.58 | 3.70 | 6.99 |
| 23 | 13.29 | 4.77 | 3.99 | 7.27 |
| 22 | 18.99 | 5.67 | 5.35 | 7.76 |
| 21 | 22.46 | 6.08 | 5.61 | 8.32 |
| 20 | 25.73 | 6.32 | 5.90 | 8.69 |
| 19 | 29.18 | 6.82 | 6.35 | 9.09 |
| 18 | 32.95 | 7.13 | 6.69 | 9.58 |
| 17 | 36.67 | 7.63 | 7.24 | 10.07 |
| 16 | 40.43 | 8.11 | 7.57 | 10.59 |
| 15 | 44.40 | 8.53 | 8.09 | 11.19 |
| 14 | 49.10 | 9.03 | 8.77 | 11.96 |
| 13 | 53.60 | 9.69 | 9.32 | 12.75 |
| 12 | 58.31 | 10.24 | 10.18 | 13.75 |
| 11 | 63.08 | 10.97 | 11.18 | 15.02 |
| 10 | 68.29 | 12.11 | 12.59 | 16.43 |
| 9 | 73.19 | 13.23 | 14.30 | 17.90 |
| 8 | 78.53 | 15.01 | 16.31 | 20.19 |
| 7 | 82.99 | 16.78 | 18.74 | 21.83 |
| 6 | 88.54 | 18.73 | 21.19 | 24.09 |
| 5 | 94.55 | 21.35 | 24.26 | 25.93 |
| 4 | 100.48 | 23.92 | 27.43 | 27.54 |
| 3 | 105.85 | 27.14 | 30.57 | 29.51 |
| 2 | 113.61 | 29.77 | 34.00 | 31.75 |
| 1 | 122.94 | 33.18 | 37.67 | 34.65 |
| 0 | 131.29 | 36.88 | 41.20 | 38.35 |

As can be seen from Table 8, the temperature/viscosity behavior of the test oil was crucially changed by the addition of the additives. While a sudden increase in viscosity was observed at 23.6° C. in the case of the uninhibited test oil, only a slight, continuous increase in the viscosity with decreasing temperature was observed in this temperature range for the samples comprising additive. Even on further cooling, the curves for the samples comprising additive were significantly flatter. The temperature/viscosity behavior of the test oil was thus crucially improved with respect to transport properties by the addition of the additives according to the invention.

What is claimed is:

1. A fuel oil comprising an additive 1 for improving cold flow properties of the fuel oil, said additive comprising a residue obtained by the extraction of crude oil with a supercritical gas.

2. A method for improving cold-flow properties of crude and distillate oils comprising combining with the crude and distillate oils an effective amount of an additive comprising a residue obtained by the extraction of crude oil with a supercritical gas.

3. A process for the preparation of an additive for improving cold flow properties of crude and distillate oils, said process comprising extracting a crude oil with a supercritical gas, isolating a resultant extraction residue, and combining the resultant extraction residue with another additive selected from the group consisting of dewaxing aids, conductivity improvers, antifoams, dispersion aids, demulsifiers, asphaltene inhibitors, gas hydrate inhibitors, scale inhibitors, paraffin dispersants, corrosion inhibitors, antioxidants, lubricity additives, dehazers, sludge inhibitors, and mixtures thereof.

4. The method of claim 2, wherein the crude and distillate oils comprise less than about 1000 ppm of the additive.

5. A process for lowering the pour point of an oil selected from the group consisting of crude oil, distillate oil, fuel oil and lubricating oil comprising combining the oil with an effective amount of an additive comprising a twice extracted residue, wherein the twice extracted residue is first extracted with a supercritical gas to provide a first residue, and the first residue is extracted in a second extraction with a non-polar solvent comprising alkanes which are liquid at room temperature to provide the twice extracted residue.

6. The fuel oil of claim 1 wherein said extraction comprises a first extraction wherein said supercritical gas is a polar solvent and a second extraction with a nonpolar solvent.

7. The fuel oil of claim 1 wherein the supercritical gas is selected from the group consisting of carbon dioxide, ethylene propane, and mixtures thereof.

8. The fuel oil of claim 1 wherein the crude oil is a conventional crude oil.

9. An additive for improving cold flow properties of crude and distillate oils prepared according to the process of claim 3.

10. The additive of claim 9, further comprising a solvent selected from the group consisting of aliphatic hydrocarbons, aromatic hydrocarbons, and mixtures thereof.

11. The additive of claim 9, further comprising a co-additive selected from the group consisting of copolymers of ethylene and ethylenically unsaturated esters, comb polymers, alkylphenol-aldehyde resins, polar compounds which effect paraffin dispersion, and mixtures thereof.

* * * * *